US006648197B2

(12) United States Patent
Perry

(10) Patent No.: US 6,648,197 B2
(45) **Date of Patent: *Nov. 18, 2003**

(54) HALO HANGER

(76) Inventor: Andrew M. Perry, 2041 State St., Salem, OR (US) 97301

( * ) Notice: Subject to any disclaimer, the term of this patent is extended or adjusted under 35 U.S.C. 154(b) by 0 days.

This patent is subject to a terminal disclaimer.

(21) Appl. No.: 10/150,411

(22) Filed: May 17, 2002

(65) Prior Publication Data

US 2002/0145026 A1 Oct. 10, 2002

Related U.S. Application Data

(62) Division of application No. 08/689,721, filed on Aug. 12, 1996.

(51) Int. Cl.[7] ..... G10G 5/00

(52) U.S. Cl. ..... 224/604; 224/251; 224/910; 984/257

(58) Field of Search ..... 224/250, 251, 224/604, 605, 910, 258, 148.1, 148.4–148.7; 84/385 A, 387 A, 453, 470 R, 380 R, 380 C; 984/128, 139, 257; 24/3.4; D3/204

(56) References Cited

U.S. PATENT DOCUMENTS 4,674,298 A * 6/1987 Wimmershoff-Caplan .. 224/251
4,841,829 A * 6/1989 Lehmann ..... 224/910
5,167,356 A * 12/1992 Williams ..... 224/251
5,203,481 A * 4/1993 Dobbins et al. ..... 224/148.4
6,384,307 B1 * 5/2002 Sueta et al.

* cited by examiner

*Primary Examiner*—Renee Luebke
(74) *Attorney, Agent, or Firm*—Marger Johnson & McCollom, P.C.

(57) ABSTRACT

An apparatus for the carrying of a woodwind musical instrument, known as a recorder, consisting of a ring with sufficient inside diameter to fit around the shaft of the recorder and a strap attached to the ring and of sufficient length so as to fit around the neck of the person playing the recorder and allowing the recorder to hang in a position of easy access to the user.

19 Claims, 2 Drawing Sheets

Fig. 1
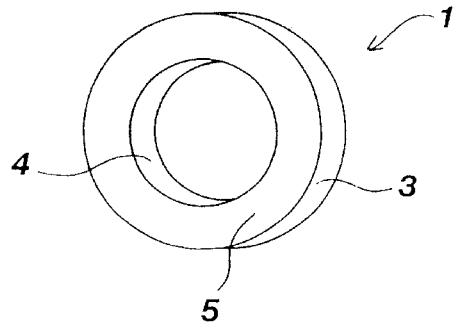
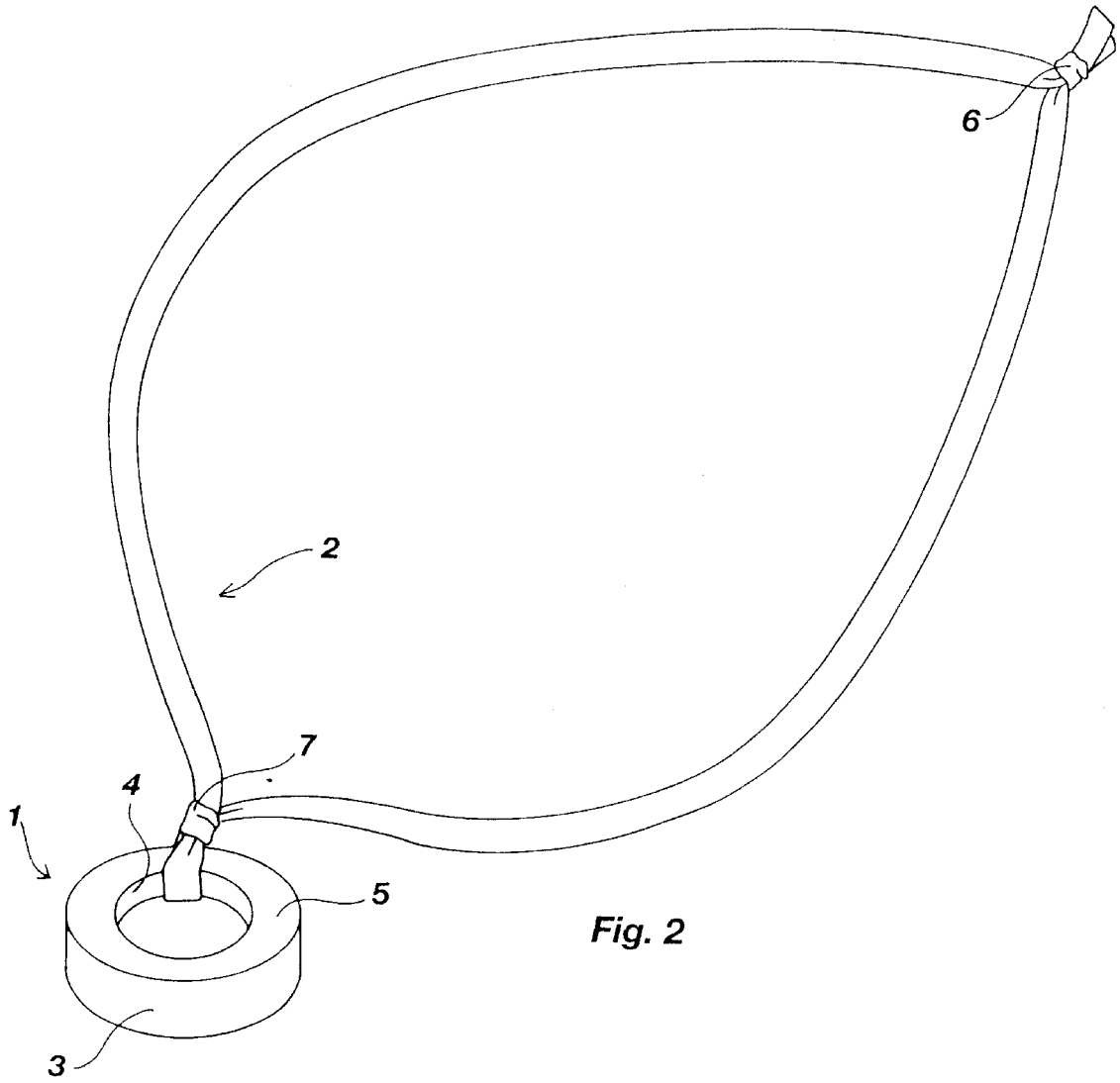
Fig. 2

HALO HANGER

CROSS REFERENCE

This application is a divisional application of pending U.S. patent application Ser. No. 08/689,721, filed Aug. 12, 1996.

BACKGROUND OF THE INVENTION

1. Field of the Invention

This invention pertains to the general field of a neck strap arrangement for carrying a musical instrument. In particular, it provides a new and improved method of carrying a woodwind musical instrument known as a recorder.

2. Description of Prior Art

The recorder is an instrument that is of such size that it can be carried easily. This instrument is most often used by children in early grade school for instruction in music. Most often the child will purchase a recorder. The child will then carry the recorder to class and carry it in the hand during class. If the child needs to use the hands for another purpose, the recorder is laid down and subject to loss or confusion when play is to be continued. Also, like anything a child is forced to carry in their hands, the object can be inappropriately used as a toy, weapon, or whatever fits the occasion.

Prior art is limited to some resourceful teachers that have simply tied a string around the recorder with some sort of loop that is placed around the child's neck to suspend the recorder. Because the knots may slip, come untied or can not be readily untied, this method has not gained wide support. In addition, after the teacher has tied all the knots required by the students, the teacher has little time left for instruction. Thus, at the present time, there is no suitable means for the hand free carrying of the recorder.

SUMMARY OF THE INVENTION

It is therefore an objective of this invention to provide a device for conveniently carrying a recorder securely affixed to a strap that is worn about the neck.

Another objective of the invention is the realization of the above mentioned objective with simple, reliable and inexpensive hardware.

In accordance with these and other objectives, the method and apparatus of this invention consist of a ring and an attached strap. The ring is made of resilient material and is of sufficient inside diameter so as to fit, after the strap has been secured to the ring, snugly around the shaft of the mouth piece of the recorder. The ring is secured on the recorder by pulling the recorder apart at its dividing point and then slipping the ring around the mouth piece section and sliding it up the shaft until it is securely lodged on the shaft. Because the diameter of the shaft, of the mouth piece section, increases from the separation point towards the other end, the ring will be secure on the recorder shaft approximately one inch from the dividing point. The two pieces of the recorder are then reconnected.

Various other purposes and advantages of the invention will become clear from its description in the specifications that follows, and from the novel features particularly pointed out in the appended claims. Therefore, to the accomplishment of the objectives described above, this invention consists of the feature hereinafter illustrated in the drawings, fully described in the detailed description of the preferred employment and particularly pointed out in the claims. However, such drawings and description disclose only some of the various ways in which the invention may be practiced.

BRIEF DESCRIPTION OF THE DRAWINGS

This invention together with its features and advantages can be better understood from the following description when read in conjunction with the drawings in which FIG. 1 is a perspective view of the ring of the device of the invention.

FIG. 2 is a perspective view of the device of the invention.

DETAILED DESCRIPTION OF INVENTION

Figure 3:
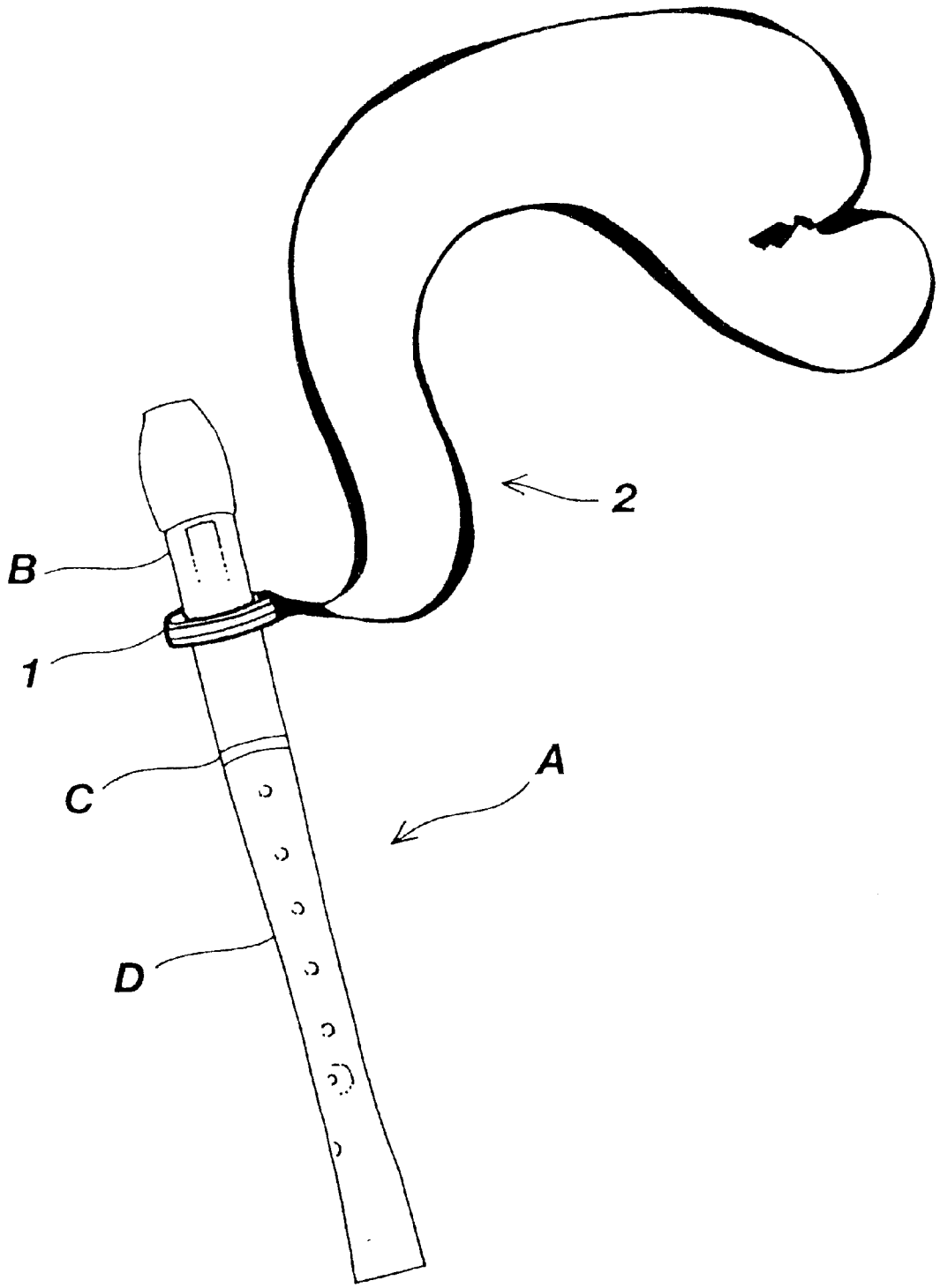
FIG. 3 is a perspective view of the device attached to a recorder.

The heart of this invention lies in the simple ring, which makes it possible to conveniently attach a strap to a recorder. Thus, the main objective of providing an easy method to carry a recorder is met.

Referring to the drawings, wherein the same reference numbers and symbols are used throughout to designate like parts, FIG. 1 illustrates the general configuration of the ring 1 before the strap 2 is attached and it is mounted on the recorder A.

The ring 1 has a surface 3 and 5 of such dimensions so as to provide strength enough to withstand the rigors and forces that would be anticipated when the device is in use by elementary age school children. The ring 1 can be made of a resilient material. As illustrated in FIG. 1, the precise geometry of the inner surface 4 of the ring is a circle with a diameter larger than the diameter of the recorder A at the point of the juncture C of the two pieces B and D of the recorder A. The diameter of the mouth piece B section of the recorder A increases from the separation point C to the air hole of the mouth piece B located just above the mid point of the mouth piece B.

The strap 2 is made of a material that is strong enough to hold the recorder or other desired object, yet be comfortable when placed around the neck. The knot 7 is tied in the middle of strap 2 after placing one end through the ring 1. Knot 6 is any knot that will neatly secure the ends of the strap 2.

The ring 1 is attached to the recorder A by pulling apart the two pieces B and D of the recorder A at the separation point C. The ring 1 is then slid onto the shaft of the mouth piece B of the recorder 1 at the end that attaches to the fingering piece D of the recorder A. The ring 1 will slip onto the mouth piece B and then lodge at a point approximately one inch up the shaft due to the slight taper of the shaft. After a suitable strap is attached to the appropriate size ring, the ring is attached to a recorder by slipping the ring onto the upper section of the recorder. The strap may be adjusted so that the recorder hangs comfortably from the neck of the person playing the recorder. While the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

Having described and illustrated the principles of the invention in a preferred embodiment thereof, it should be apparent that the invention can be modified in arrangement and detail without departing from such principles.

What is claimed is:

1. A combination, comprising:

a resilient ring;

a strap attached to the ring; and a recorder, wherein the ring is disposed around a shaft of the recorder.

2. A combination according to claim 1, wherein the shaft contains no bulges.

3. A combination according to claim 1, wherein the recorder is a two-piece recorder and wherein the recorder can be separated into sections at a separation point along the shaft for placement of the ring around the recorder shaft.

4. A combination according to claim 3, wherein the recorder shaft is gradually tapered from the separation point to a mouth piece end, so that the recorder shaft is larger at the mouth piece end than at any other point along the shaft between the separation point and the mouth piece end.

5. A combination according to claim 4, wherein an internal diameter of the ring has a size that fits around the shaft of the recorder near the separation point thereof and lodges at a point along the shaft, located between the separation point and the mouth piece end, that does not interfere with any fingering holes or air holes of the recorder.

6. A combination according to claim 1, wherein the ring has an internal diameter having a size that matches an external diameter of the shaft of the recorder at a point along a portion thereof.

7. A combination according to claim 1, wherein the strap is a neckstrap configured to support the recorder from a neck of a user.

8. A combination, comprising:

a two-piece recorder comprising a shaft separable into a first section and a second section at a separation point, a mouth piece disposed at a first end of the first section of the shaft, wherein a diameter of the shaft gradually increases from the separation point toward the first end of the first section of the shaft;

a ring disposed around the first section of the shaft, said ring comprising an internal diameter having a size that matches the diameter of the shaft at a point along the first section of the shaft spaced between the separation point and the mouth piece; and a strap attached to the ring and configured to suspend the recorder and the ring from a neck of a user.

9. A combination according to claim 8, wherein the ring is disposed around the first section of the shaft by separating the recorder into sections, placing the ring on the first section, and sliding the ring toward the first end of the first section until it becomes lodged on the shaft.

10. A method of suspending a recorder from a strap, the method comprising:

forming a ring of a resilient material having an internal diameter that matches an external diameter of a recorder shaft at a point along the shaft;

attaching the ring to a separate strap; and lodging the ring around the recorder shaft at the point along the shaft, such that the recorder ring does not obstruct any fingering or air holes of the recorder.

11. A method according to claim 10, wherein the strap is a neckstrap, said method further comprising placing the neckstrap around a neck of a user.

12. A method according to claim 10, wherein the recorder is a two-piece recorder having a separation point near a midpoint along the recorder shaft, and wherein disposing the ring around the recorder shaft comprises separating the recorder pieces at the separation point and placing the ring around the recorder shaft.

13. A method according to claim 10, wherein the recorder comprises a gradually tapered, bulgeless shaft and wherein disposing the ring around the shaft of the recorder comprises disposing the ring around a narrower portion of the shaft and sliding the ring towards a wider portion of the shaft.

14. A method according to claim 13, further comprising lodging the ring on the shaft of the recorder.

15.A recorder ring combination comprising:

a recorder;

a ring comprising means for lodging the ring around a shaft of the recorder; and a neckstrap attached to the ring, wherein the ring is constructed of a resilient material.

16. A recorder ring combination according to claim 15, wherein the recorder is a two-piece recorder having a separation point and a mouth piece.

17. A recorder ring combination according to claim 16, wherein the shaft of the recorder tapers gradually from the separation point towards the mouth piece.

18. A recorder ring combination according to claim 17, wherein the means for lodging the recorder ring around the recorder shaft comprises a ring diameter that is larger than the recorder shaft at the separation point but smaller than the recorder shaft at the mouth piece.

19. A recorder ring combination according to claim 15, wherein the means for lodging the ring around the recorder shaft comprises an internal ring diameter having a size that matches an external diameter of the shaft at a point along the shaft that will not conflict with any fingering or air holes of the recorder.

* * * * *

UNITED STATES PATENT AND TRADEMARK OFFICE

CERTIFICATE OF CORRECTION

PATENT NO. : 6,648,197 B2
DATED : November 18, 2003
INVENTOR(S) : Perry

It is certified that error appears in the above-identified patent and that said Letters Patent is hereby corrected as shown below:

Column 2,
Line 63, “apparatus and methods.” should read -- apparatus and methods. ¶ DETAILED DESCRIPTION ¶ --.
Line 68, “such principles.” should read -- such principles. I claim all modifications and variation coming within the spirit and scope of the following claims. --.

Signed and Sealed this

Thirty-first Day of August, 2004

JON W. DUDAS
*Director of the United States Patent and Trademark Office*